United States Patent [19]

Draxler

[11] Patent Number: 4,758,189

[45] Date of Patent: Jul. 19, 1988

[54] DAMAGE RESISTANT SPARK PLUG TERMINAL CONNECTOR

[75] Inventor: James R. Draxler, Fond du Lac, Wis.

[73] Assignee: Brunswick Corporation, Skokie, Ill.

[21] Appl. No.: 50,555

[22] Filed: May 14, 1987

[51] Int. Cl.[4] ..... H01R 11/22; H01R 13/18

[52] U.S. Cl. ..... 439/848; 439/125

[58] Field of Search ..... 439/125–129, 439/756, 759, 819, 823, 843–848

[56] References Cited

U.S. PATENT DOCUMENTS

| | | | |
|---|---|---|---|
| 3,223,963 | 12/1965 | Rarey et al. | 439/846 |
| 3,364,459 | 1/1968 | Schiller | 439/848 |
| 3,573,709 | 4/1971 | Elliott | 439/125 |
| 3,597,723 | 8/1971 | Schmidt et al. | 439/125 |
| 3,965,879 | 6/1976 | Fitzner | 123/148 P |
| 4,009,924 | 3/1977 | Bungo et al. | 439/848 |
| 4,209,221 | 6/1980 | Chupak et al. | 439/848 |

*Primary Examiner*—Gil Weidenfeld
*Assistant Examiner*—Gary F. Paumen
*Attorney, Agent, or Firm*—Andrus, Sceales, Starke & Sawall

[57] ABSTRACT

A spark plug terminal connector for providing an electrical connection of a lead to a spark plug terminal includes a U-shaped seat for receiving the spark plug terminal and a conductor formed integrally therewith for providing an electrical connection of the lead to the seat. A U-shaped spring grip is adapted to fit around the closed end of the U-shaped seat, and has a pair of resilient opposed engaging fingers for retaining the spark plug terminal within the seat. The engaging fingers urge the spark plug terminal against the seat for providing an electrical connection thereto. The connector may be disengaged from the spark plug terminal with a pull-off motion in a direction other than in line with the longitudinal axis of the spark plug terminal without incurring damage to the connector. The resilient opposed engaging fingers yield to allow the connector to pass during such disengagement, and return to their original position thereafter to provide a secure electrical connection after repeated engagements and disengagements.

10 Claims, 2 Drawing Sheets

DAMAGE RESISTANT SPARK PLUG TERMINAL CONNECTOR

BACKGROUND AND SUMMARY

This invention relates to electrical connectors, and more particularly to connectors for providing an electrical connection of a lead to a spark plug terminal.

In some engine applications, it is necessary or desirable for an electrical lead to approach a spark plug at an angle. Frequently, an angle of 90° is the optimal angle of approach. A potential problem created by such an arrangement is that the lead may be improperly removed from the spark plug terminal by a person pulling on the lead. This action can result in the spreading of the elements which engage the spark plug terminal. Such spreading impairs the ability of the connenctor to subsequently provide a secure electrical connection to a spark plug terminal.

It is desirable to have a lead connector which allows for the improper removal of the lead connector from the spark plug terminal. The lead connector should be reusable to provide a secure electrical connection of the lead to the spark plug terminal after such improper removal.

The invention is designed to provide such an electrical lead connector. In accordance with the invention, a spark plug terminal receiving means is provided to engage the spark plug terminal, and a resilient terminal grip means is provided for gripping the spark plug terminal and retaining the terminal within the receiving means. The receiving means is configured such that it cannot be distorted by any pull off motion, regardless of direction. The terminal grip means is yieldable so as to allow the connector to be disengaged from the spark plug terminal by means of a pull-off motion in a direction other than in line with the longitudinal axis of the spark plug terminal. The resilient terminal grip means is displaced from its normal position during insertion of the spark plug terminal into the receiving means, and returns at least partially to its normal position after insertion for gripping the spark plug terminal and providing an electrical connection to the receiving means. During disengagement of the lead connector from the spark plug terminal using a pull-off motion other than in line with the longitudinal axis of the spark plug terminal, the resilient terminal grip means again is displaced from its normal position to allow the spark plug terminal to be disengaged from the connector, and returns to its original position thereafter. Upon return of the resilient terminal grip means to its original position, the connector provides a secure electrical connection to the spark plug terminal, even after the above-described improper removal. Therefore, this terminal is always able to provide a secure electrical connection, even after abusive handling. A conductor means is provided for electrically connecting the receiving means to the electrical lead.

BRIEF DESCRIPTION OF THE DRAWINGS

Prior Art

Present Invention

Figure 3:
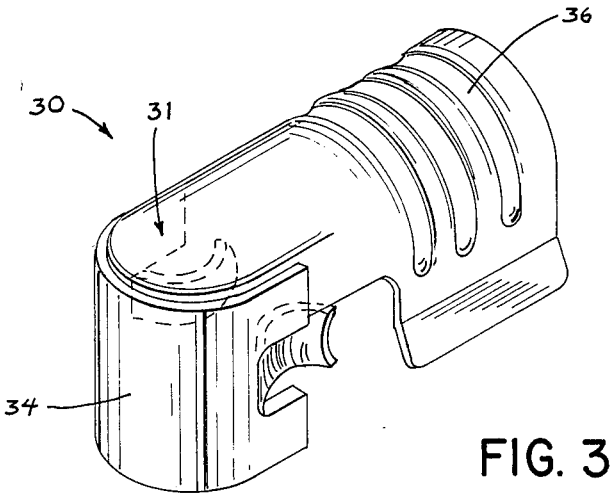
Figure 4:
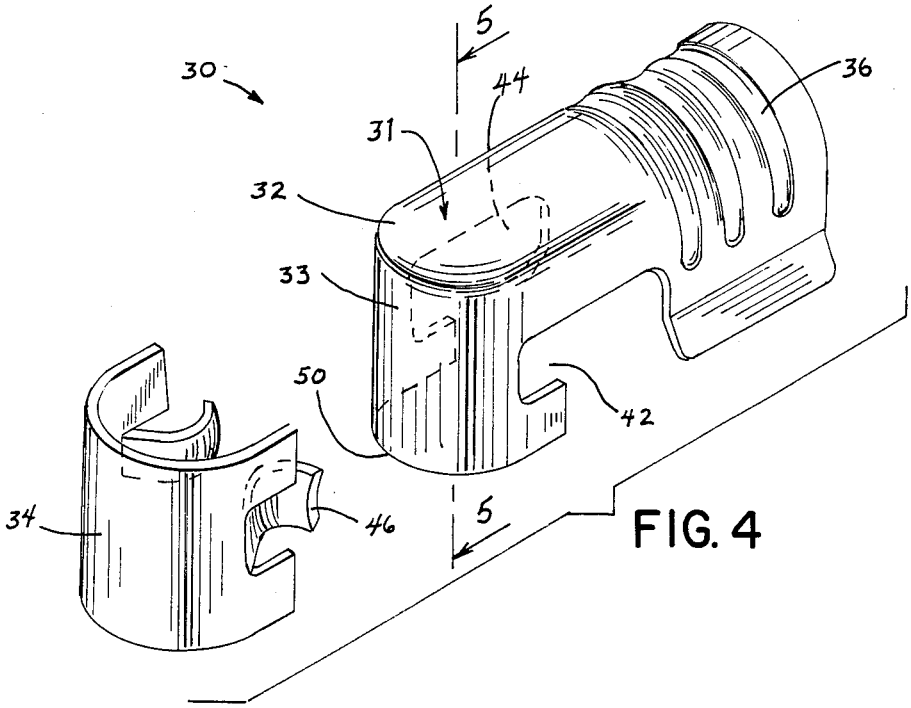
Figure 5:
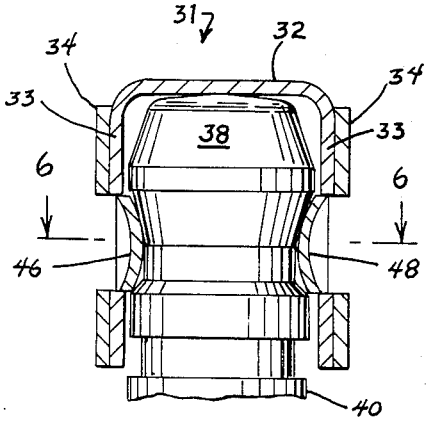
Figure 6:
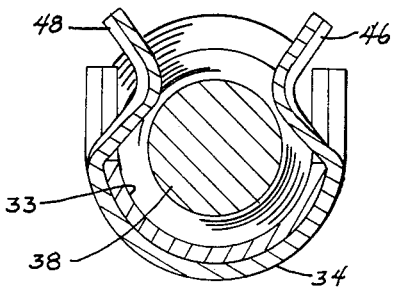

FIG. 3 is an assembled perspective view of a spark plug terminal connector in accordance with the invention;

FIG. 4 is an exploded perspective view of the spark plug terminal connector of FIG. 3;

FIG. 5 is an assembled sectional view taken along line 5—5 of FIG. 4, showing a spark plug terminal; and FIG. 6 is a sectional view taken along line 6—6 of FIG. 5.

DETAILED DESCRIPTION

Description of the Prior Art

Figure 1:
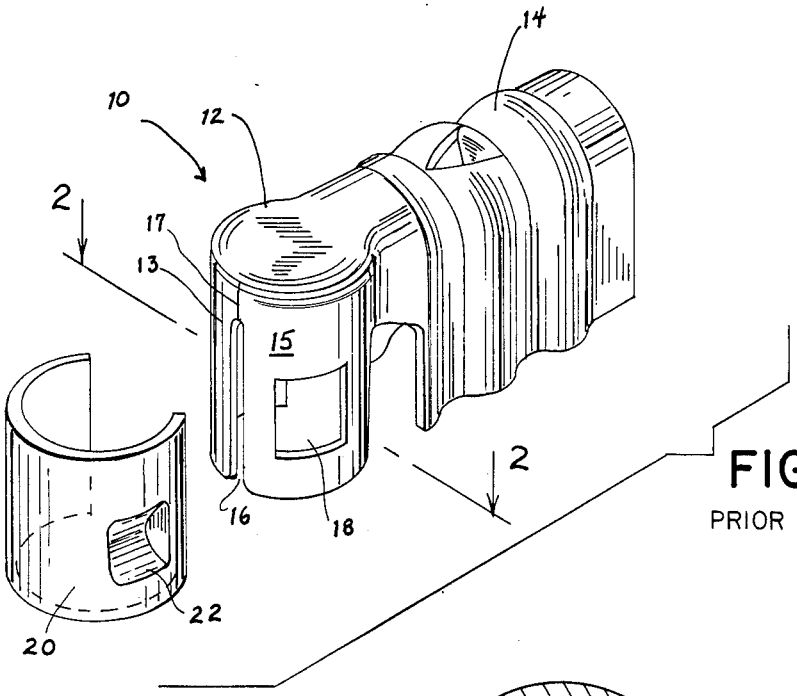
FIG. 1 PRIOR ART
FIG. 1 is an exploded perspective view of a commonly used right-angle spark plug lead connector.

FIG. 1 shows a spark plug terminal connector 10, as is commonly known. Connector 10 includes a spark plug terminal seat 12, which is integrally connected to a conductor 14. Terminal seat 12 has side walls 13 and 15 which essentially define an open-sided cylinder. The open side of seat 12 leads to conductor 14, and a gap 16 leading to a seam 17 separates side walls 13 and 15 on the opposite side of seat 12. A slot 18 is disposed in side wall 15 between gap 16 and the open side of cylindrical seat 12 leading to conductor 14.

Conductor 14 is adapted to receive an electrical lead and to be crimped therearound, to provide an electrical connection of the lead to seat 12.

A C-shaped clip 20 is adapted to fit around side walls 13 and 15 of cylindrical seat 12. Clip 12 has an inwardly-projecting protrusion 22 punched in its side. Protrusion 22 is adapted to mate with slot 18 when connector 10 is assembled by engaging C-shaped clip 20 with side walls 13 and 15 of cylindrical seat 12.

When the connector 10 is assembled, inwardly-projecting protrusion 22 of clip 20 engages the spark plug terminal for retaining the terminal within seat 12.

Figure 2:
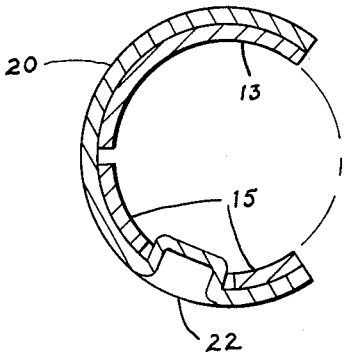
FIG. 2 PRIOR ART
FIG. 2 is a partial assembled sectional view taken along line 2—2 of FIG. 1.

When connector 10 is removed from the spark plug terminal using a pull-off motion in a direction other than in line with the longitudinal axis of the spark plug terminal, the spark plug terminal passes from seat 12 out the open side of seat 12 leading to conductor 14. As seen in FIG. 2, the spark plug terminal is wider than the opening in the open side of cylindrical seat 12 defined by side walls 13 and 15. The passing of the spark plug terminal through the narrow opening defined by side walls 13 and 15 overstresses the metal of walls 13 and 15, resulting in the walls not returning to their original position after removal of the spark plug terminal as described. As a result, the C-shaped clip 20 is prevented from engaging its protruding detent 22 into the central groove of the spark plug and can no longer provide a secure electrical connection to the spark plug terminal due to the spreading of side walls 13 and 15.

Description of the Invention

FIGS. 3–6 show a spark plug terminal connector 30 in accordance with the present invention. Terminal connector 30 includes a receiving means such as a substantially U-shaped spark plug terminal seat 31 having an end wall 32 and a depending side wall 33, a resilient terminal grip means such as a substantially U-shaped spark plug terminal grip 34, and a conductor 36 formed integrally with seat 31. Conductor 36 is an inverted trough extending from the open end of U-shaped seat 31, and adapted to receive an electrical lead. A lead is placed within trough 36 and the walls of trough 36 are crimped therearound to provide an electrical connection of the lead to seat 31.

As shown in FIG. 5, end wall 32 and side wall 33 of seat 31 are adapted to receive a terminal 38 of a spark plug 40, being designed to provide a slip fit so that wall 33 fits snugly around terminal 38. Side wall 33 is substantially U-shaped, so that the portions of wall 33 leading to conductor 36 are substantially tangential to the curved portion forming the closed end of the U-shape. Side wall 33 of seat 31 is provided with a slot 42 on one side and a slot 44 on the other side.

U-shaped terminal grip 34 is adapted to fit around side wall 33 of seat 31. Terminal grip 34 is constructed from spring steel or other resilient material. Terminal grip 34 has a pair of opposed inwardly-extending terminal grip fingers 46 and 48 struck out therefrom. Terminal grip 34 is curved corresponding to the curve of side wall 33 of U-shaped seat 31, and is adapted to fit therearound. Fingers 46 and 48 have a concave curvature relative to the curved portion of terminal grip 34. As shown in FIG. 5, fingers 46 and 48 have a curved cross section, adapted to interface with the inwardly curved portion of spark plug terminal 38. During assembly, terminal grip 34 is forced onto side wall 33 of seat 31, so that fingers 46 and 48 engage with slots 42 and 44, respectively. As shown in FIGS. 5 and 6, fingers 46 and 48 thus project into the interior of the U-shape defined by side wall 33 of seat 31. Terminal grip 34 is retained on connector 30 by the engagement of fingers 46 and 48 with slots 42 and 44, respectively.

Connector 30 is adapted to be engaged with spark plug terminal 38 using a push-on motion in a direction in line with the longitudinal axis of spark plug terminal 38. During engagement, fingers 46 and 48 are displaced from their normal position by flexing outwardly to allow spark plug terminal 38 to pass into engagement with seat 31. Upon passage of the top of terminal 38 past fingers 46 and 48, fingers 46 and 48 return at least partially to their original position and engage terminal 38, to retain terminal 38 within seat 31 and to provide an electrical connection thereto. Fingers 46 and 48 urge spark plug terminal 38 against the rounded end of side wall 33 of seat 31.

Connector 30 may be disengaged from spark plug terminal 38 with either a pull-off motion in the same direction as the push-on motion above described, or with a pull-off motion at an angle to the direction of the push-on motion. During disengagement using a pull-off motion in line with the push-off motion, the above-described steps take place in reverse order. With a pull-off motion at an angle to the direction of push-on motion, the fingers 46 and 48 spread apart to allow spark plug terminal 38 to pass out the open end of U-shaped seat 31. During disengagement in this manner, lower edge 50 of side wall 33 engages spark plug terminal 38 to provide a pivot point, about which terminal connector 30 rotates counterclockwise during removal. The counterclockwise rotation of connector 30 results in the passage of spark plug terminal 38 through the opening defined by resilient fingers 46 and 48. After passage of terminal 38 through this opening, resilient fingers 46 and 48 return to their original position without any deformation. Fingers 46 and 48 of spring member 34 are always allowed to return to their original position, even after repeated improper removals.

Since side wall 33 of connector 30 does not encircle the spark plug terminal by more than 180°, plug terminal 38 is allowed to pivot out of seat 31 without distorting the relatively soft metal of connector 30. Connector 30 thus does not suffer the same distortion of the side walls as do other existing connectors which encircle the plug terminal by more than 180°, as shown in FIG. 2.

It is recognized that various equivalents, alternatives and modifications are possible within the scope of the appended claims.

I claim:

1. A connector for connecting an electrical lead to a spark plug terminal, said connector adapted to be engaged with said spark plug terminal by means of a push-on motion generally in line with the longitudinal axis of the spark plug terminal, comprising:

receiving means including a cavity for receiving said spark plug terminal without distortion of said receiving means, said receiving means including a cavity including a passage having a width configured to be at least as wide as sparkplug terminal for allowing said connector to be disengaged from said spark plug terminal by means of a pull-off motion in a direction substantially different than the direction of said push-on motion by allowing said spark plug terminal to pass through said passage without distortion of said receiving means;

resilient terminal grip means cooperating with said receiving means for gripping said spark plug terminal and retaining said spark plug terminal within said receiving means for providing an electrical connection of said spark plug terminal thereto, said terminal grip means being yieldable so as to allow said connector to be disengaged from said spark plug terminal by means of a pull-off motion in a direction substantially different than the direction of said push-on motion, and said terminal grip means being capable of returning to its original position so that said connector is reusable and provides a secure electrical connection to said spark plug terminal subsequent to disengagement from said spark plug terminal using said pull-off motion.

2. The invention according to claim 1, wherein said receiving means comprises a seat for receiving said spark plug terminal, and wherein said resilient terminal grip means extends into said opening and urges said spark plug terminal against said seat for providing an electrical connection thereto.

3. A connector for connecting an electrical lead to a spark plug terminal, said connector adapted to be engaged with said spark plug terminal by means of a push-on motion generally in line with the longitudinal axis of the spark plug terminal, comprising:

receiving means for receiving said spark plug terminal without distortion of said receiving means and for allowing said connector to be disengaged from said spark plug terminal by means of a pull-off motion in a direction substantially different than the direction of said push-on motion without distortion of said receiving means, said receiving means comprising a substantially U-shaped seat for receiving said spark plug terminal in the interior of a closed end thereof; and resilient terminal grip means cooperating with said seat for gripping said spark plug terminal and retaining said spark plug terminal therein and urging said spark plug terminal against said seat for providing an electrical connection of said spark plug terminal thereto, said terminal grip means comprising a yieldable spring adapted to fit around the exterior of the closed end of said U-shaped seat, said spring being provided with finger means for urging said spark plug terminal against the closed end of said U-shaped seat, said finger means allowing said connector to be disengaged from said spark plug terminal by means of a pull-off motion in a direction substantially different than the direction of said push-on motion, sand being capable of returning to its original position so that said connector is reusable to provide a secure electrical connection to said spark plug terminal subsequent to disengagement from said spark plug terminal using said pull-off motion.

4. The invention according to claim 3, wherein said finger means comprises a pair of resilient fingers disposed in said spring, said fingers being arranged so as to be on opposite sides of said U-shaped seat and engageable with said spark plug terminal.

5. The invention according to claim 1, further comprising conductor means for electrically connecting said receiving means to said electrical lead, said conductor means being formed integrally with said receiving means.

6. The invention according to claim 5, wherein said receiving means comprises a seat adapted to receive said spark plug terminal, and said conductor means comprises a trough extending from said seat and adapted to receive an electrical lead, so that said lead can be placed within said trough and the walls of said trough closed therearound to provide an electrical connection of said lead to said spark plug terminal.

7. The invention according to claim 1, wherein the longitudinal axis of said lead and the longitudinal axis of said spark plug terminal are substantially perpendicular.

8. A connector for connecting an electrical lead to a spark plug terminal, comprising:

receiving means for receiving the terminal of a spark plug without distortion of said receiving means, said receiving means including a passage having a width configured to be at least as wide as said sparkplug terminal for allowing said connector to be disengaged from said spark plug terminal by means of a pull-off motion in a direction substantially different than in line with the longitudinal axis of the spark plug terminal by allowing said spark plug terminal to pass through said passage without distortion of said receiving means;

resilient retainer means including a pair of opposed resilient fingers cooperating with said receiving means for retaining said spark plug terminal within said receiving means, said resilient fingers extending into said cavity and adapted to flex outwardly from their normal position during insertion of said spark plug terminal into said receiving means and to return at least partially to their original position after said spark plug terminal is in place within said receiving means for grippings and retaining said spark plug terminal therein.

9. The invention according to claim 8, wherein said opposed resilient fingers in cooperation with said receiving means allow said connector to be disengaged from said spark plug terminal with a pull-off motion at an angle to the longitudinal axis of said spark plug, said resilient fingers being displaced from their normal position during said disengagement and returning to their normal position thereafter so that said connector is reusable and provides a secure electrical connection to said spark plug terminal subsequent to disengagement using said pull-off motion.

10. The invention according to claim 9, wherein said receiving means includes a seat adapted to receive said spark plug terminal, and said retainer means includes a spring having a shape corresponding to the shape of said seat and adapted to fit therearound, said spring having said pair of resilient opposed engaging fingers formed integrally therewith for retaining said spark plug terminal within said seat and for urging said spark plug terminal against said seat for providing an electrical connection thereto, said fingers being capable of returning to their normal position after repeated displacements thereform during insertion and disengagement of said spark plug terminal.

* * * * *

UNITED STATES PATENT AND TRADEMARK OFFICE

CERTIFICATE OF CORRECTION

PATENT NO. : 4,758,189

DATED : July 19, 1988

INVENTOR(S) : James R. Draxler

It is certified that error appears in the above-identified patent and that said Letters Patent is hereby corrected as shown below:

Col. 2, line 30, Delete "12" and substitute therefor ---20---;

Claim 1, col. 4, lines 16-17, After "receiving means" delete "including a cavity";

Claim 1, col. 4, line 18, After "as wide as" insert ---said---;

Claim 3, col. 5, line 8, Delete "sand" and substitute therefor ---and---;

Claim 8, col. 6, line 15, Delete "grippings" and substitute therefor ---gripping---;

Claim 10, col. 6, line 40, Delete "thereform" and substitute therefor ---therefrom---

Signed and Sealed this

Twenty-eighth Day of March, 1989

*Attest:*

DONALD J. QUIGG

*Attesting Officer*

*Commissioner of Patents and Trademarks*